US008348783B2

(12) United States Patent
Soracco et al.

(10) Patent No.: US 8,348,783 B2
(45) Date of Patent: Jan. 8, 2013

(54) BUTT-MOUNTED SHAFT EXTENSION FOR A GOLF CLUB

(76) Inventors: Peter L. Soracco, Carlsbad, CA (US); Bradford Hughes Hartwell, Carlsbad, CA (US); Kenneth C. Scott, San Marcos, CA (US)

( * ) Notice: Subject to any disclaimer, the term of this patent is extended or adjusted under 35 U.S.C. 154(b) by 351 days.

(21) Appl. No.: 12/760,884

(22) Filed: Apr. 15, 2010

(65) Prior Publication Data

US 2011/0256949 A1 Oct. 20, 2011

(51) Int. Cl.
*A63B 53/14* (2006.01)
*A63B 53/16* (2006.01)

(52) U.S. Cl. ..... 473/296; 473/298

(58) Field of Classification Search ..... 473/294, 473/296, 298–299
See application file for complete search history.

(56) References Cited

U.S. PATENT DOCUMENTS

| | | | | | |
|---|---|---|---|---|---|
| 1,557,156 | A | | 10/1925 | Gless | |
| 1,613,360 | A | | 1/1927 | Rigby | |
| 1,634,082 | A | | 6/1927 | Rigby | |
| 1,634,887 | A | | 7/1927 | Rigby | |
| 2,446,622 | A | * | 8/1948 | Turner | 69/21 |
| 2,468,202 | A | * | 4/1949 | Karns | 473/300 |
| D160,396 | S | * | 10/1950 | Karns | D21/756 |
| 2,604,660 | A | * | 7/1952 | Karns | 264/278 |
| 2,604,661 | A | * | 7/1952 | Karns | 425/116 |
| 2,704,668 | A | * | 3/1955 | Park | 473/300 |
| 3,516,697 | A | | 6/1970 | Hahn | |
| 3,539,185 | A | * | 11/1970 | Andis | 473/296 |
| 4,826,168 | A | | 5/1989 | McGuire et al. | |
| 5,024,438 | A | | 6/1991 | Candow | |
| 5,294,117 | A | * | 3/1994 | Huang | 473/523 |
| 5,390,921 | A | | 2/1995 | DeRuyter | |
| 5,584,096 | A | * | 12/1996 | Aurora | 16/421 |
| 5,626,527 | A | * | 5/1997 | Eberlein | 473/203 |
| 5,649,870 | A | | 7/1997 | Harrison | |
| 6,196,930 | B1 | | 3/2001 | Aumock | |
| 6,413,168 | B1 | | 7/2002 | McKendry | |
| 6,511,386 | B1 | * | 1/2003 | Cacicedo | 473/300 |
| 7,018,302 | B2 | | 3/2006 | Jacoby | |
| 7,159,451 | B2 | | 1/2007 | McGann et al. | |
| 7,250,005 | B2 | | 7/2007 | Wood et al. | |
| 7,261,641 | B2 | * | 8/2007 | Lindner | 473/297 |
| 7,611,422 | B2 | | 11/2009 | Hocknell et al. | |
| 7,699,718 | B2 | * | 4/2010 | Lindner | 473/297 |
| 7,704,161 | B2 | * | 4/2010 | Lindner | 473/297 |
| D622,341 | S | * | 8/2010 | Pepin | D21/756 |
| 2003/0148819 | A1 | * | 8/2003 | Lindner | 473/316 |
| 2005/0143186 | A1 | | 6/2005 | Blattner et al. | |
| 2009/0270197 | A1 | * | 10/2009 | Holtzman | 473/296 |

FOREIGN PATENT DOCUMENTS

GB 2309389 A * 7/1997

* cited by examiner

*Primary Examiner* — Stephen L. Blau
(74) *Attorney, Agent, or Firm* — D. Michael Burns

(57) ABSTRACT

A device designed for extending a golf club shaft. The device is a three-piece mechanism with a bottom piece bonded into the top end of a tubular golf club shaft, and a plurality of top piece sizes that are removably connected to the bottom piece and provide the adjustments in club length. A special golf grip having an accordion like plurality of rings can expand or contract in accordance with the amount of club length adjustment.

5 Claims, 9 Drawing Sheets

BUTT-MOUNTED SHAFT EXTENSION FOR A GOLF CLUB

FIELD OF THE INVENTION

The present invention relates generally to a device for adjusting the length of a golf shaft. In particular, the invention concerns extending the length of the shaft by utilizing the device at the gripping end of the club.

BACKGROUND OF THE INVENTION

One of the most important factors in golf club equipment is the club shaft. The shaft transfers the golfer's power to the club. It provides the length, the flex, the torque and the weight for the club, therein giving the swing plane and shot desired.

Golf club shafts are available in various types of materials and structures. Steel shafts are stronger, last longer, more durable and generally less expensive than graphite or carbon fiber shafts, and are usually made from carbon steel, although stainless steel is sometimes used. The steel shafts are available in stepped or rifle designs. The graphite shafts are more expensive and less durable, however, the lighter weight creates greater swing speed for more power. Also available are multi-material and titanium shafts.

When installing a shaft, the proper length must be accurately determined. The length is as important to a golf shaft as is the flex or torque. Most measurements of shaft length involve a determination of a particular player's height and distance of his hands to the floor. Shaft length will impact whereon the clubface the ball will be consistently struck, and often, an incorrect shaft length is the main cause of a golfer to alter his natural swing arc in order to make optimum impact. According to most research, if ball impact is but 1 inch off-centre this can equate to a 14% loss of carry distance, so it is vitally important that the length of the club be accurately fitted for each particular player.

If it is seen in the fitting process that a player needs to adjust his club, such as adding an inch or two to the length of the club, it would be highly desirable to lengthen his present club(s) rather buy and install new shafts.

Prior art shafts having adjustable lengths have been used for many years for a wide variety of applications. Each of these applications has its own functional and aesthetic requirements for the shaft construction which is employed. As a consequence, a number of different mechanisms and devices have been developed to satisfy the particular application requirements. A majority of golf club shaft extension patents are directed to use mainly as putters, or to extending shafts of an existing set of clubs to accommodate growing children. While the teachings of the present invention may be adopted to these type of applications, the focus is rather to make a club adjustment that is rigid, secure, and easily fastened.

SUMMARY OF THE INVENTION

The present invention provides for an extension device for use on the butt-end of a golf club shaft. The device consists of three basic parts: a top piece; a bottom piece; and an inner screw. The bottom piece is bonded, by glue or epoxy, into the tubular opening in the top of the club shaft. The top piece is attached to the bottom and provides for an extension in the club length. The invention can be used to extend any of the golf clubs in a set, but preferably is designed for use with a driver. Holding the device together in a tight unitary structure is an inner screw that traverses through the pieces.

In one embodiment of the invention the bottom piece has a plurality of resilient legs that are inserted and bonding into the upper end of the shaft. The top piece is attached in a removable sliding relationship to the bottom piece and by rotation of the inner screw, the device can extend and contract. The greatest variation in shaft length is basically achieved by having multiple top pieces that vary in length, however, minor adjustments in length can be achieved by rotation of the inner screw, therein causing the top piece to either expand or contract from the bottom piece. Once the device is installed it is covered by a grip. The invention requires the use of a special grip that has an opening in the butt-end for access of a tool wielded by the golfer, whereby by turning the inner screw the golfer can make small but important refinements in club length. The grip includes a series of pleated rings that can expand or contract like an accordion in response to changes in length of the device.

Another embodiment of the invention attaches the top piece into a bottom piece by essentially snapping the pieces together and then tightening the device with a screw traversing through the pieces. The varying extensions of the shaft being achieved by the selection of interchangeable top pieces of varying lengths.

Another embodiment of the invention forms the device by screwing the top piece into the bottom piece and tightening the device with an inner screw.

Other advantages of the invention will be more fully apparent from the appended claims.

DETAILED DESCRIPTION OF THE INVENTION

Figure 1:
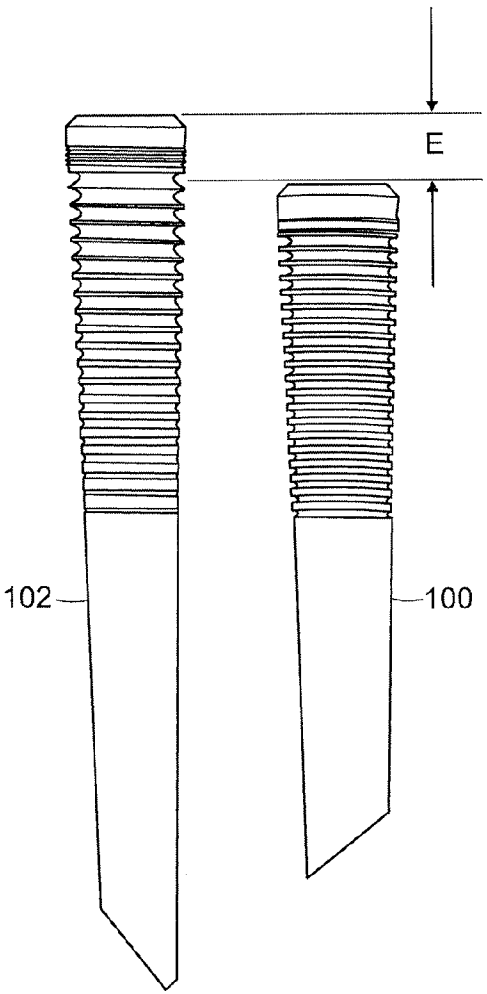
FIG. 1 is a view of two club shaft butt-ends, one illustrating the club when in the standard position and the other when the club shaft has been extended.

FIG. 1 shows the comparison in the grip end between a standard club 100 and a club 102 that has been adjusted by the extension device of the present invention. The amount of the extension E is typically between 0.125 to 3 inches.

Figure 2:
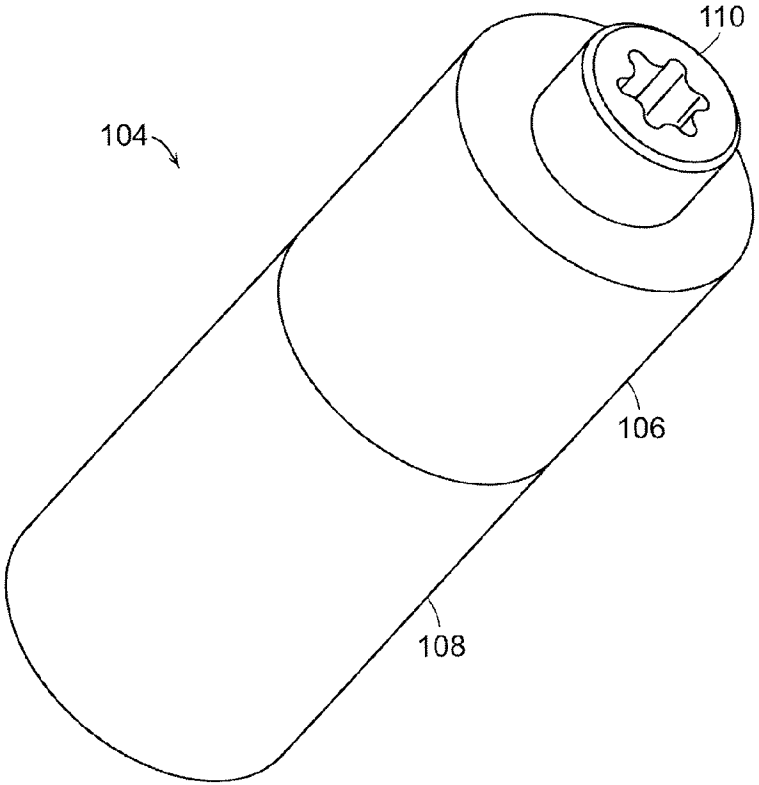
FIG. 2 is a pictorial view of the extension mechanism when in a complete state.

FIG. 2 is an illustration of the generic device 104 of the present invention. It is comprised of three basic pieces, a top piece 106, a bottom piece 108, and an inner screw 110 that holds the device securely together.

Figure 3:
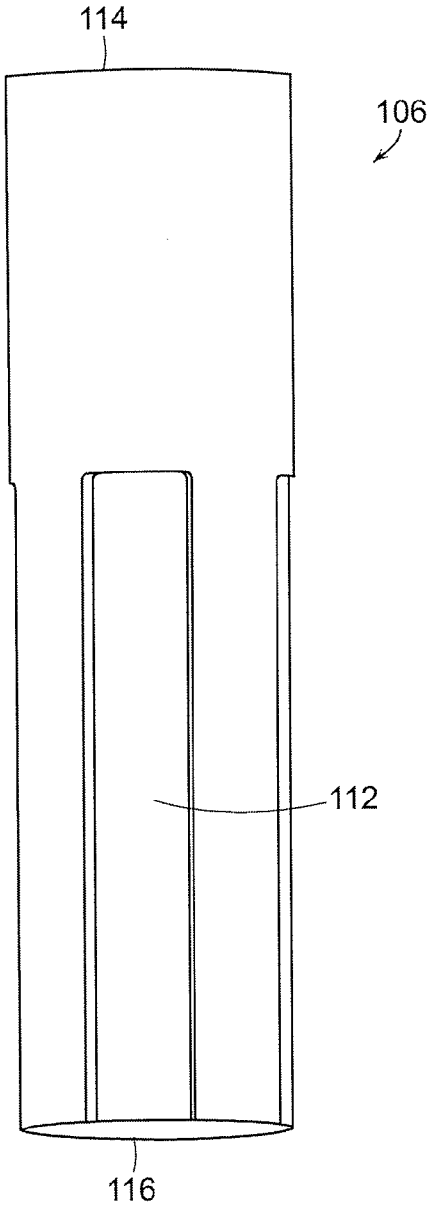
FIG. 3 is a symmetrical lengthwise view of the top piece of the butt extension.
Figure 4:
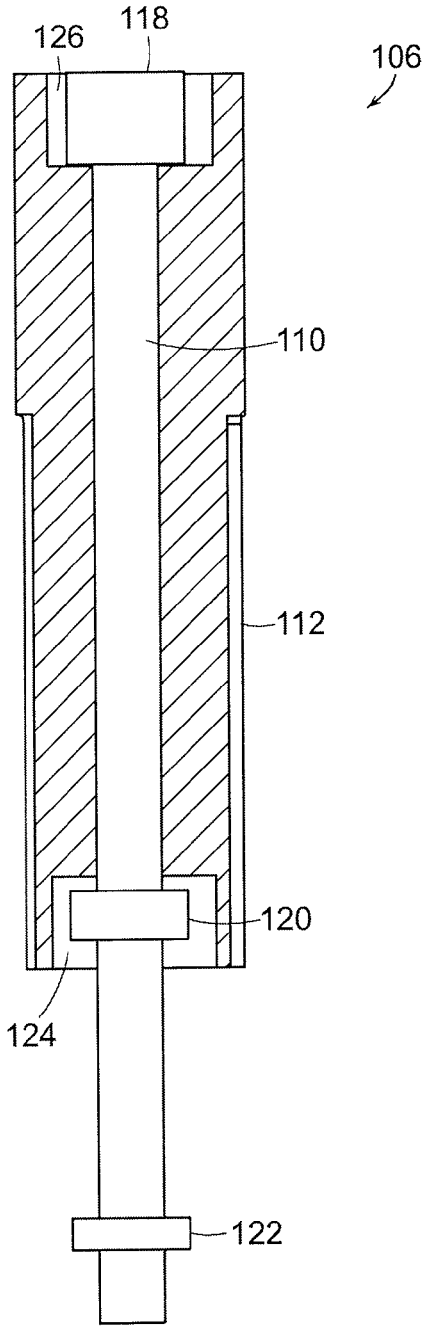
FIG. 4 is a cross sectional view of FIG. 3 with the turning screw installed.
Figure 5:
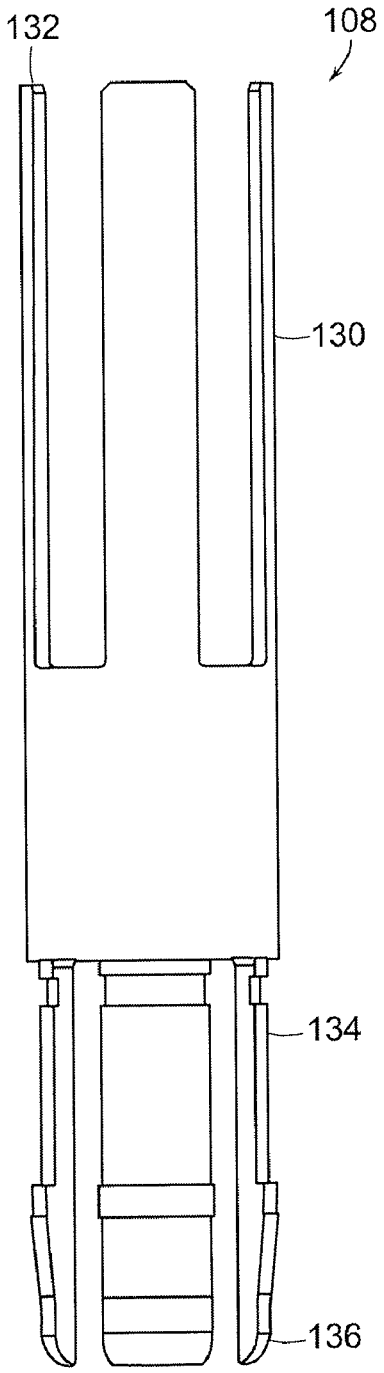
FIG. 5 is a symmetrical view of the bottom piece of the butt extension.
Figure 6:
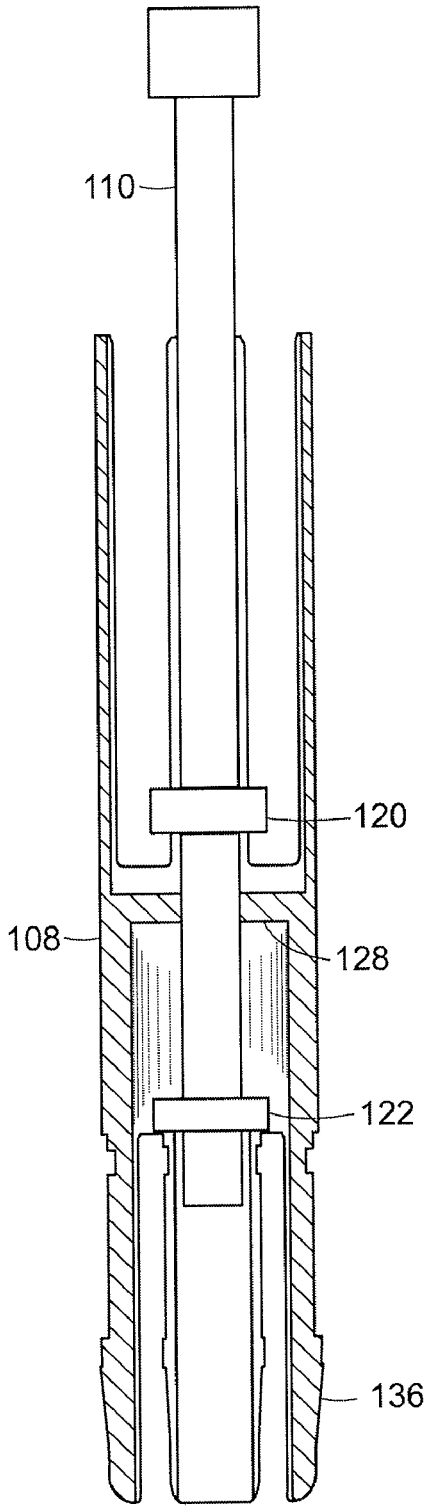
FIG. 6 is a cross-sectional view of FIG. 5 with the turning screw installed.

FIGS. 3 and 4 describe the top piece 106 of this invention which consists of a longitudinal cylindrical sidewall containing a plurality of slots 112 defined therein. The slots 112 are molded into the top piece 106 and preferably there are three. The upper end 114 of the top piece 106 contains an upper recess 126 for seating of the top end 118 of the inner screw 110. The lower end 116 has a lower recess 124 defined therein and between the recesses 124, 126 is a clearance hole along the axis of the top piece 106 for free passage of the inner screw 110. As seen in FIG. 4, these recesses 124, 126, provide room to securely hold the inner screw 110 which has a conventional type of fitting and is capable of being turned by a conventional tool. The inner screw 110 contains first and second locking nuts 120, 122 essential to the operation of the device as described below. The bottom end of the screw 110, although not shown in FIG. 4 is threaded on the lower portion.

FIGS. 5-8 describe the bottom piece 108 which comprises a plurality of fingers 130 which extend upwardly and have distal ends 132. The fingers are preferably three in number and are shaped and sized to coordinately slide into and within the slots 112 of the top piece 106. The lower section of the bottom piece 108 has a plurality of resilient legs 134 which have distal ends 136 that are pressed with great bias into the open top end of the golf shaft, this is best shown on FIGS. 7-9.

Figure 7:
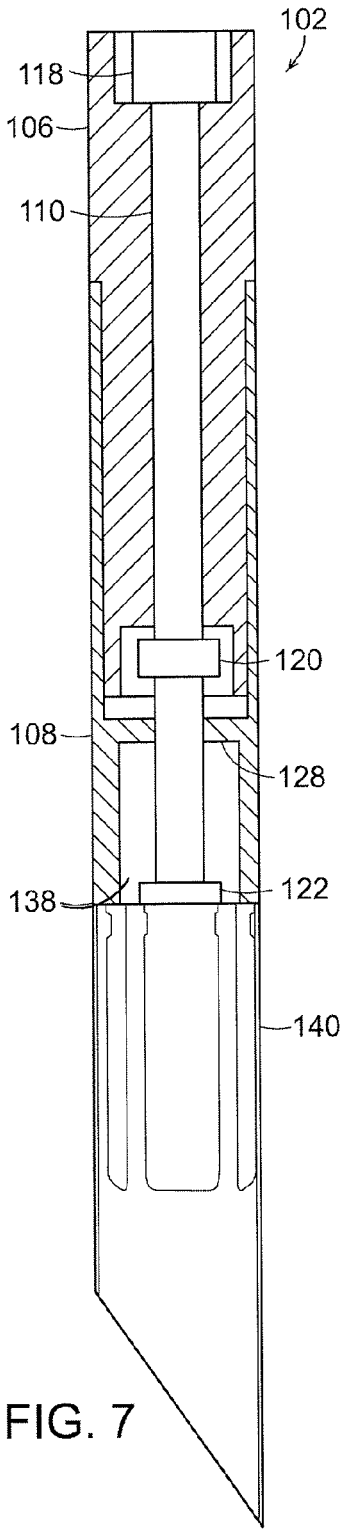
FIG. 7 is a cross-sectional view of the mechanism bonded to top of club shaft.
Figure 8:
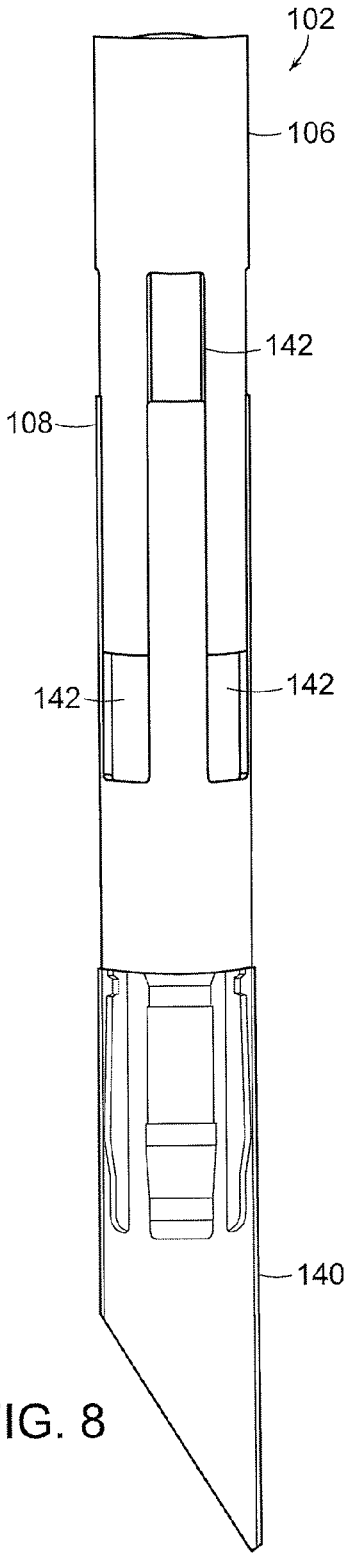
FIG. 8 is a symmetrical view of the shaft with length extended.

FIGS. 6-9 show the second locking nut 122 of the inner screw 110 movably disposed in the chamber 138 of the bottom piece 108, as it is free to traverse within the chamber 138 when actuated by the turning of the screw 110. FIGS. 7-8 illustrate the entire device 102 with the bottom piece 108 bonded, by glue or epoxy, to the inner wall of the golf club shaft 140. In a standard position, shown in FIG. 7, the fingers 130 of the bottom piece 108 come to an abutment with the slots 112 of the top piece 106. At that point any lengthening of the shaft is due entirely to the length of the device extending from the top of the shaft. FIG. 8 is illustrative of what results when the device has been actuated by turning the screw 110 and the first and second locking nuts 120, 122 come into engagement with the top piece 106 therein lifting the top piece away from the bottom piece 108. The amount of this extension tweaking can be indicated by the distance of the gaps 142 that appear in FIG. 8. The length of the adjustment is controlled by the second locking nut 122 coming to rest against the stop 128. While not shown, the chamber 138 is threaded to allow a controlled, precise movement therein. The gaps 142 are not of a size that would be perceivable to the golfer through the grip 112.

Figure 9:
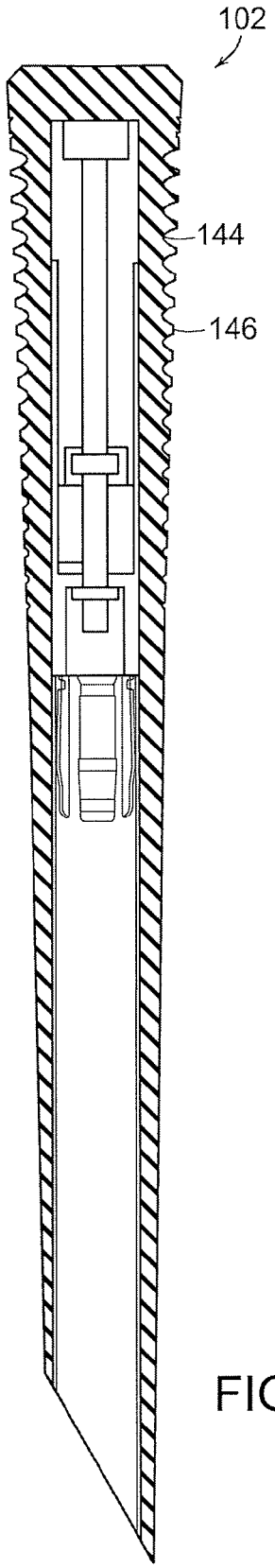
FIG. 9 is a cross-sectional view of the grip covering the mechanism.
Figure 10:
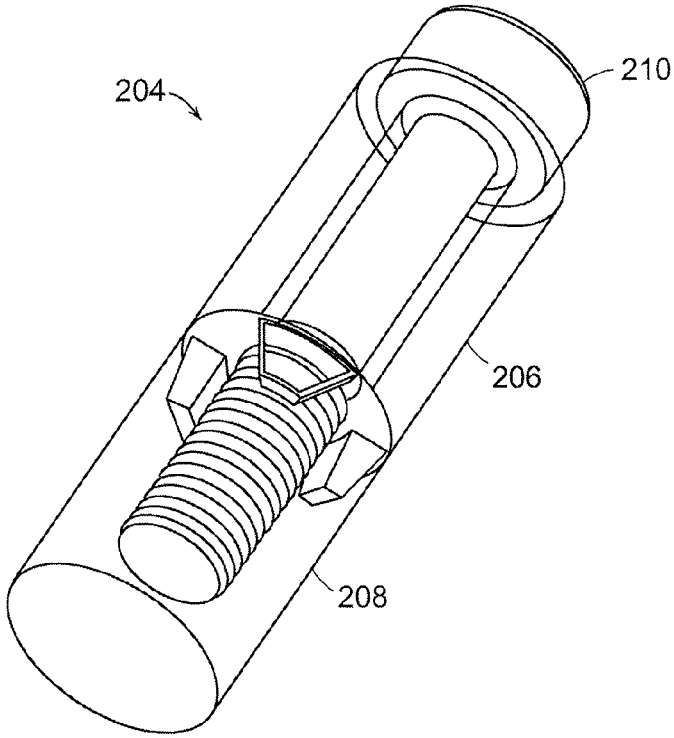
FIG. 10 is a perspective view of another embodiment of the invention.
Figure 11:
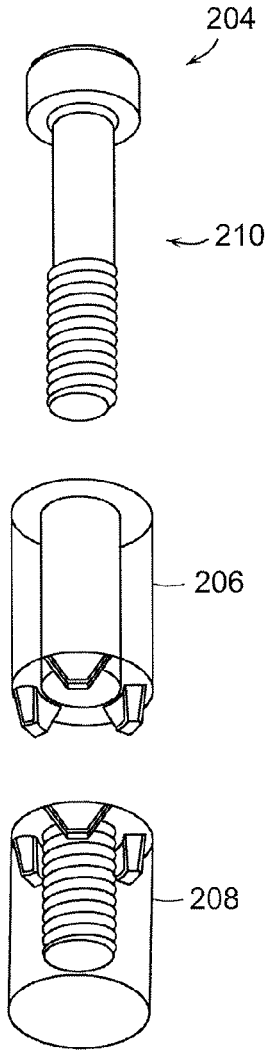
FIG. 11 is an expanded bottom perspective view of the embodiment of FIG. 10.
Figure 13:
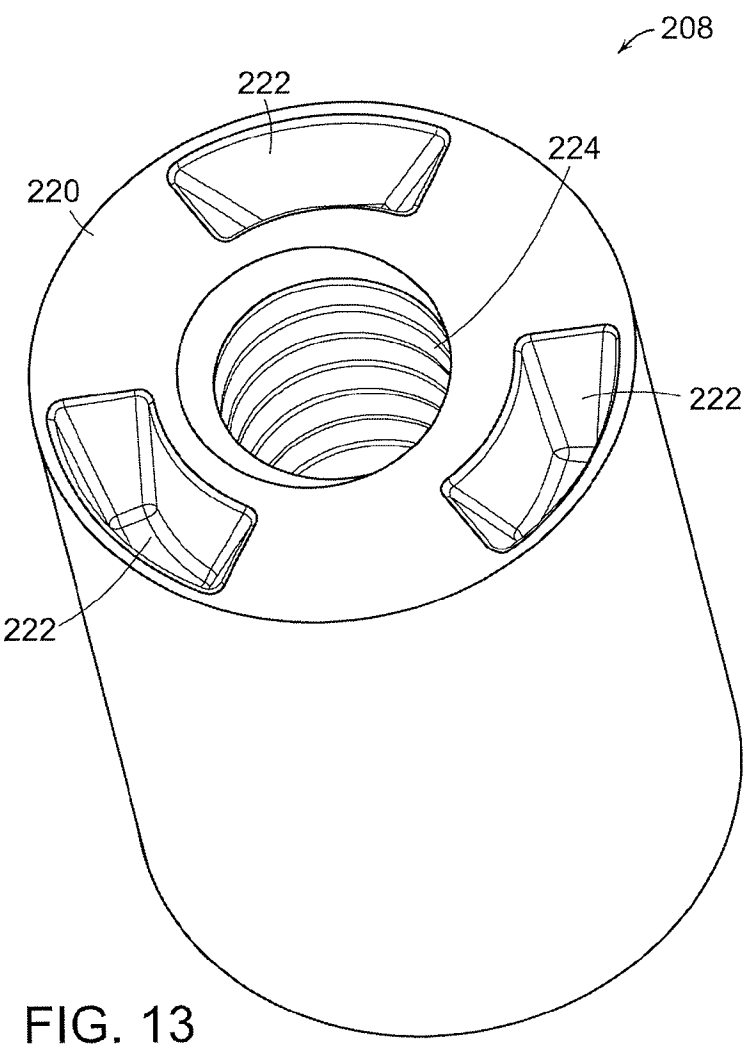
FIG. 13 is a top perspective view of the lower portion of FIG. 10.
Figure 12:
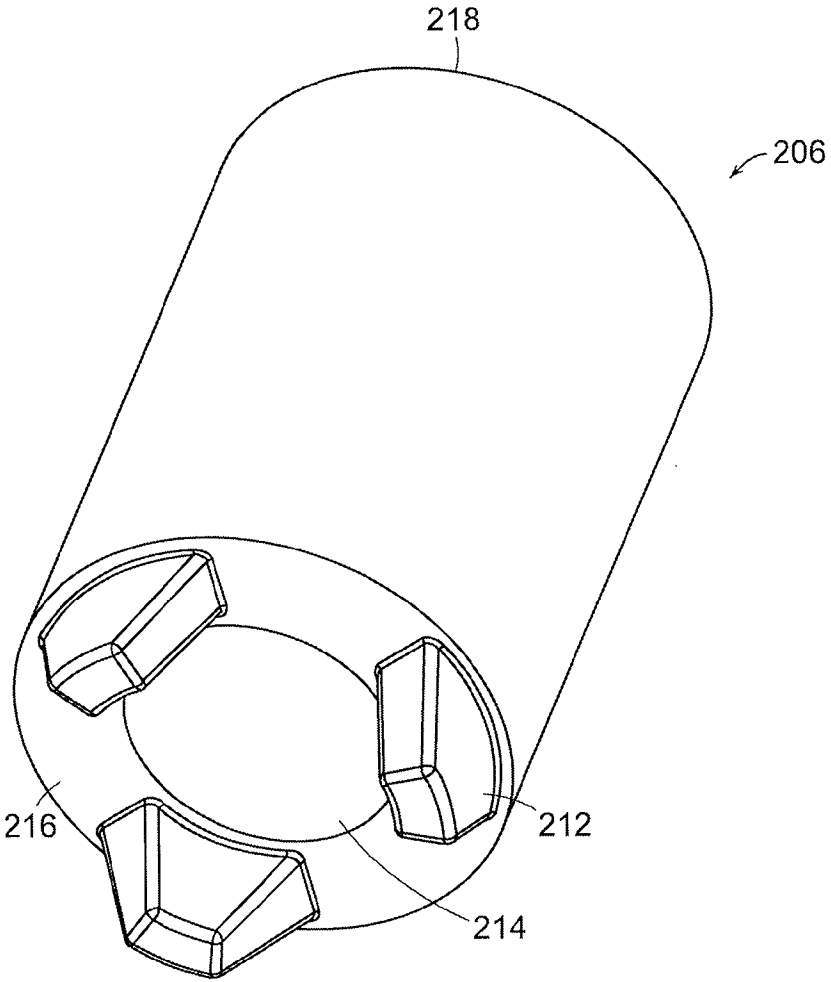
FIG. 12 is a perspective view of the upper portion of FIG. 10.
Figure 15:
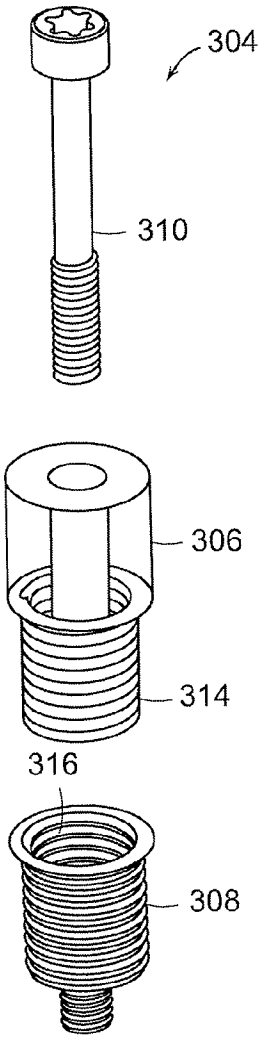
FIG. 15 is an expanded view of the device shown in FIG. 14.
Figure 14:
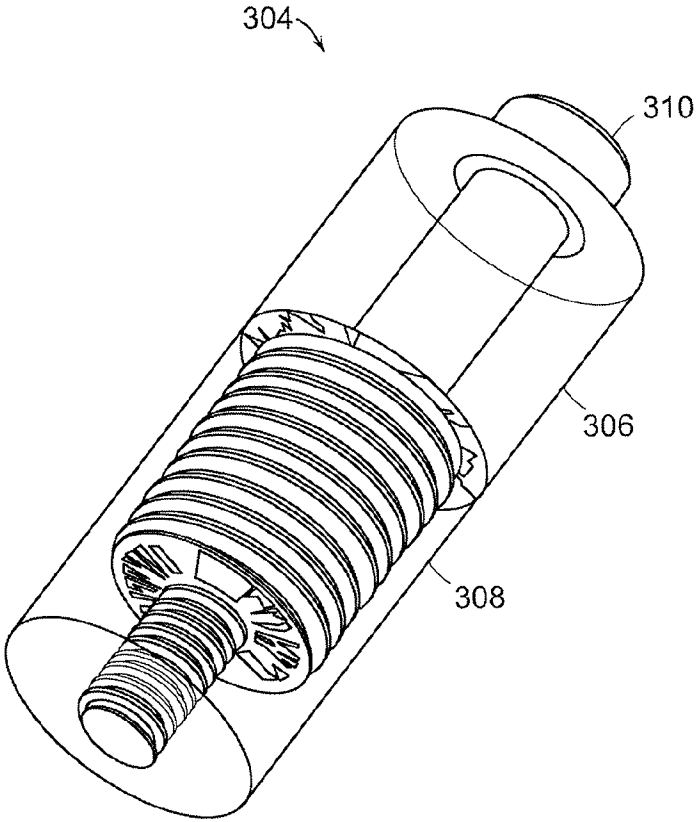
FIG. 14 is a detailed prospective view of another embodiment of the invention.
Figure 17:
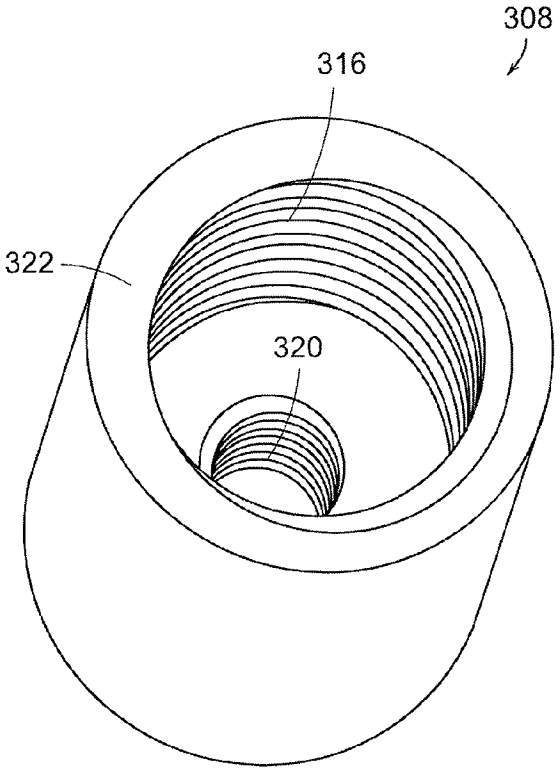
FIG. 17 is a perspective view of the lower portion of the device of FIG. 14.
Figure 16:
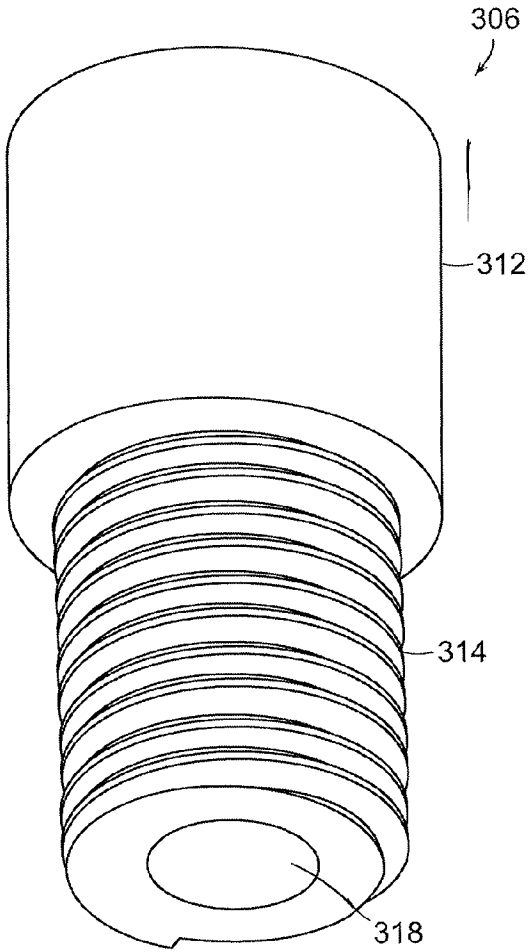
FIG. 16 is a perspective view of the upper portion of the device of FIG. 14.

FIG. 9 is a cross-sectional view of the entire device 104 installed in the tubular shaft 140 with the grip 144 having pleated rings 146. Since the device 104 may vary in length, it is necessary that the grip is capable of adjusting to various shaft lengths. The grip shown in FIG. 9 has pleated rings that operate like an accordion when the grip stretches or contracts to accommodate the various extensions of the device. The grip 144 has a top opening for access of the tool to adjust the length or remove the top piece.

Another embodiment of the invention is shown on FIGS. 10-13, wherein a device 204 has basic three pieces, the top piece 206, the bottom piece 208 and the inner screw 210. This embodiment 204 presses the bottom piece 208 into the upper shaft 140 of the golf club and connects the top and bottom pieces by snap-fitting a plurality of teeth 212 located on the lower surface 216 of the top piece 206 into a like number of receptacles 222 defined in the upper surface 220 of the bottom piece 208. The preferred number of teeth 212 and receptacles 222 being three. With this embodiment, varying the extension length is a direct function of the varying lengths of the top piece 206. The device 204 is tightened by an inner screw 210 which is located at the upper surface 218 of the top piece 206 and traverses the top piece through a cylindrical opening 214 and then screws into a threaded section 224 of the bottom piece 208. In actual operation, the user rotates the screw 210 by using a standard tool that fits in an opening at the top of the grip. To adjust the length the golfer removes the screw 210 and unsnaps the top piece 206 from the bottom piece 208 and replaces it with a top piece of another size length, either shorter or longer, therein causing the change to the overall the club length.

Another embodiment of the invention is shown in FIGS. 14-17, wherein the top piece 306 is screwed into the bottom piece 308 and the inner screw 310 tightens and secures the device 304. The top piece 306 has a longitudinal cylindrical opening 318 that runs through the piece which has two major segments: a cylindrically shaped upper body 312 and a large threaded segment 314 for screwing into the bottom piece 308. The bottom piece has a large threaded receptacle 316 in the top surface 322 of the bottom piece 308 for accepting the large threaded segment 314 of the top piece and a smaller threaded opening 320 for accepting the threaded bottom section of the inner screw 310. To adjust the length of the shaft, the golfer removes the screw 310 and unscrews the top piece 306 from the bottom piece 308 and as above replaces it with a top piece of another length, either shorter or longer, therein creating the desired overall the club length.

Conformance with the rules of golf and acceptance by the USGA is an important consideration in this invention. As discussed above, the features of lengthening the club shaft must be such that it is virtually impossible to assemble and use in a manner which is not conforming. An aspect of this conformance is that any club with adjustable parts must have its parts firmly fixed with no reasonable likelihood of them working loose during a round of golf. The use of the inner screw and structure of the top and bottom pieces assures such protection.

It will be understood that various modifications to the preferred embodiment disclosed above may be made. The above description is not intended to limit the meaning of the words used in the following claims that define the invention. Rather, it is contemplated that future modifications in structure, function or result will exist that are not substantial changes and that all such insubstantial changes are intended to be covered by the following claims.

What is claimed is:

1. An extension device for a golf club shaft, comprising:

a top piece, a bottom piece, an inner screw, and a grip to cover the device;

the bottom piece bonded into a tubular opening in the top of the golf club shaft;

the top piece having a longitudinal cylindrical outer sidewall with slots defined therein, and including an upper recess and a lower recess;

the bottom piece having a plurality of fingers extending from an upper portion, the fingers dimensioned to slide within the slots therein engaging the top piece to the bottom piece, and having a chamber with a stop at the top of the chamber; and the inner screw having a top section disposed in the upper recess of the top piece, a first locking nut disposed in the lower recess of the top piece, a second locking nut disposed in the chamber of the bottom piece, a threaded lower end seated into a treaded section of the bottom piece, wherein a golfer by using an appropriate tool can turn the inner screw to further adjust the club length by causing the second locking nut to transverse within the length of the chamber to either extend or shorten the overall length of the club the length of the shaft.

2. The extension device of claim 1, wherein the bottom piece has a plurality of resilient legs for insertion and bonding into an upper end of a tubular golf club shaft.

3. The extension device of claim 2, wherein the bottom piece is bonded into the golf club shaft by glue or epoxy.

4. The extension device according to claim 1, wherein the grip comprises a series of pleated rings that expand or contract in compliance with length adjustments of the shaft.

5. The extension device according to claim 4, wherein the grip has an opening in the butt-end of the grip to allow access of a tool to rotate the inner screw.

* * * * *